US006054804A

United States Patent [19]

Oshima et al.

[11] Patent Number: 6,054,804

[45] **Date of Patent: *Apr. 25, 2000**

[54] CATHODE RAY TUBE APPARATUS

[75] Inventors: Yoshifumi Oshima; Nozomu Arimoto; Atsushi Suzuki, all of Osaka, Japan

[73] Assignee: Matsushita Electronics Corporation, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/970,675

[22] Filed: Nov. 14, 1997

[30] Foreign Application Priority Data

Nov. 28, 1996 [JP] Japan ..... 8-317387

[51] Int. Cl.[7] ..... H01J 1/24; H01J 19/18

[52] U.S. Cl. ..... 313/430; 313/432; 313/439

[58] Field of Search ..... 313/429, 430, 313/431, 439, 432; 335/213, 214, 297, 299

[56] References Cited

U.S. PATENT DOCUMENTS 5,404,084 4/1995 Onodera et al. ..... 315/370
5,449,975 9/1995 Madsen ..... 315/85
5,789,872 8/1998 Kohga et al. ..... 315/370

FOREIGN PATENT DOCUMENTS 7-288831 10/1995 Japan .

*Primary Examiner*—Nimeshkumar D. Patel
*Assistant Examiner*—Michael J. Smith
*Attorney, Agent, or Firm*—Merchant & Gould P.C.

[57] ABSTRACT

A cathode ray tube apparatus that can reduce the leakage extraneous electric field with low cost. The cathode ray tube apparatus comprises a front panel, a glass bulb having a funnel part including an anode terminal at the outer surface thereof and a neck part including an electron gun, a deflection apparatus comprising a horizontal deflection coil on the outer surface of the funnel part and the neck part of the glass bulb, a flyback transformer connected to the anode terminal of the funnel part via a first lead wire having an insulating coating, and a leakage extraneous electric field controller installed on the first lead wire. The controller reduces the leakage of the extraneous electric field from the first lead wire. It is preferable that the leakage extraneous electric field controller comprises a negative pulse generator generating negative pulses having a reverse polarity and a synchronized period with respect to the horizontal deflection voltage signal of the horizontal deflection coil, a conductor at least partially surrounding the insulation coated first lead wire, and a second lead wire connecting the negative pulse generator and the conductor.

16 Claims, 7 Drawing Sheets

CATHODE RAY TUBE APPARATUS

BACKGROUND OF THE INVENTION

1. Field of the Invention

The present invention relates to a cathode ray tube apparatus used for a television display, a display monitor and so on.

2. Description of the Prior Art

The reduction of extraneous electric fields leaked from a cathode ray tube apparatus is important because the cathode ray tube apparatus generates strong electric fields. As shown in FIG. 5, in order to reduce the extraneous electric fields, a conventional cathode ray tube apparatus includes a negative pulse generator 1 that generates negative pulses having a horizontal deflection period and the generator includes a smoothing capacitor 2 whose capacity is from 3000 to 6000 (pF). The conventional cathode ray tube apparatus compensates for ripples of the high-pressure voltage HV having a horizontal deflection period by superimposing the negative pulses generated by the negative pulse generator 1 via the smoothing capacitor 2 onto the high-pressure voltage HV. Therefore, the cathode ray tube apparatus can compensate for the extraneous electric fields generated by pulses having a horizontal deflection period from a deflecting yoke etc (JP Tokkai-Hei 7-288831 Japanese publication of the unexamined patent application).

However, the above-mentioned conventional cathode ray tube apparatus has a disadvantage in cost because of the expensive smoothing capacitor 2 having the large capacity for reducing the extraneous electric fields.

SUMMARY OF THE INVENTION

An object of the invention is to provide a cathode ray tube apparatus reducing the extraneous electric fields leaked therefrom to the outside down to the desired low level.

In order to achieve this object and advantage of the invention, a first aspect of the cathode ray tube apparatus of the present invention comprises a front panel, a glass bulb comprising a funnel part including an anode terminal at the outer surface thereof, a neck part including an electric gun, a deflection apparatus comprising a horizontal deflection coil on the outer surface of the funnel part and the neck part of the glass bulb, a flyback transformer connected to the anode terminal of the funnel part via a first lead wire having an insulating coating, and a leakage extraneous electric field controller installed on the first lead wire, the controller reducing the leakage of the extraneous electric field from the first lead wire.

According to this aspect and advantage of the invention, the cathode ray tube apparatus can reduce the leakage of the extraneous electric fields caused by the ripples having a horizontal deflection period included in the first lead wire.

In the above-mentioned configuration, it is preferable that the leakage extraneous electric field controller comprises a negative pulse generator generating negative pulses having a reverse polarity and a synchronized period with respect to the horizontal deflection voltage signal of the horizontal deflection coil, a conductor at least partially surrounding the insulating coating of the first lead wire, and a second lead wire connecting the negative pulse generator and the conductor.

In the above-mentioned configuration, it is preferable that the leakage extraneous electric field controller applies the negative pulses to the conductor via the second lead wire, and reduces the leakage extraneous electric field of the first lead wire by compensating the ripples in the signals of the first lead wire with the negative pulses applied to the conductor.

According to this aspect of the invention, the cathode ray tube apparatus can compensate the ripples having the horizontal deflection period included in the first lead wire by superimposing the negative pulses generated by the negative pulse generator onto the high voltage signal of the first lead wire via the capacitance formed between the first lead wire and the conductor. Therefore, the cathode ray tube apparatus can reduce the leakage of the extraneous electric field generated from the ripples having the horizontal deflection period included in the first lead wire. In addition, the smoothing capacitor, which is conventionally required, is not needed because the required capacitance is formed between the first lead wire and the conductor.

In the above-mentioned configuration, it is preferable that the conductor is formed at an end of the flyback transformer side of the first lead wire.

In the above-mentioned configuration, it is preferable that the conductor is formed at an end of the first lead wire in the flyback transformer.

According to this aspect of the invention, the conductor can be installed in the flyback transformer and the cathode ray tube apparatus can achieve a higher safety level.

In the above-mentioned configuration, it is preferable that the conductor is configured as a tubular conductor net.

In the above-mentioned configuration, it is preferable that the conductor is a conductor film formed on the insulation coated first lead wire.

In the above-mentioned configuration, it is preferable that the conductor is formed by coiling the end of the first lead wire side of the second lead wire onto the insulation coated surface of the first lead wire.

According to this aspect of the invention, the configuration of the cathode ray tube apparatus can be simplified because the conductor can be formed by an end of the second lead wire.

In the above-mentioned configuration, it is preferable that the conductor is formed at the end part of the insulation coated first lead wire near the outside of the flyback transformer.

According to this aspect of the invention, the capacitance between the conductor of the second lead wire and the first lead wire can be varied and adjusted by varying the number of turns and the pitch of the turns of the spiral coil of the second lead wire.

In the above-mentioned configuration, it is preferable that the conductor is insulation coated.

According to this aspect of the invention, the cathode ray tube apparatus can reduce the leakage of the extraneous electric field more.

DESCRIPTION OF THE PREFERRED EMBODIMENTS

First Embodiment

The first embodiment of the present invention will be described with reference to FIG. 1 and FIG. 2.

Figure 6:
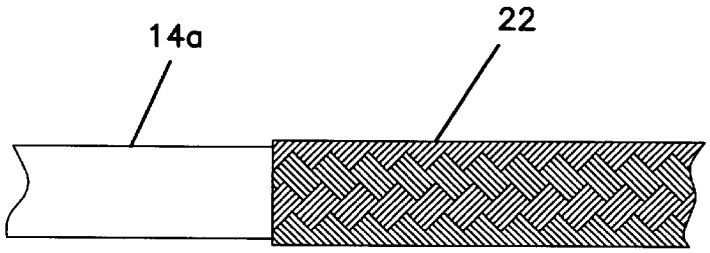
FIG. 6 is an enlarged view of a tubular conductor net.

An example of a cathode ray tube apparatus that can be used in the present invention will be explained referring to FIG. 1, which shows a side cross-sectional view of a cathode ray tube apparatus. As shown in FIG. 1, the cathode ray tube apparatus comprises a front panel 3, a glass bulb 10, a deflection apparatus 12, a horizontal deflection circuit 13, a first lead wire 14, a flyback transformer 15 and a leakage extraneous electric field controller 16. The glass bulb 10 comprises a funnel-shape part 7, which includes an anode terminal 5 connected to an inner conducting layer 4 and an outer conducting layer 6 connected to the ground, and a neck part 9, which includes an electron gun 8. The deflection apparatus 12 comprises the horizontal deflection coil 11 formed on the outer surface of the funnel-shape part 7 and neck part 9 of the glass bulb 10. The horizontal deflection circuit 13 applies the horizontal deflection voltage to the horizontal deflection coil 11. The flyback transformer 15 is connected to the anode terminal 5 of the funnel-shape part 7 via the insulation coated first lead wire 14. The leakage extraneous electric field controller 16 installed at the first lead wire 14 reduces the leaked electric field FIG. 2 shows an example of a schematic diagram of a flyback transformer and a leakage extraneous electric field controller. As shown in FIG. 1, the flyback transformer 15 comprises a first coil 17 supplying electric power, a second coil 18 enhancing the supplied voltage from the first coil 17 in order to obtain the high voltage pulses, a diode 19 rectifying the supplied high voltage pulses from the second coil 18 in order to obtain the direct current high voltage, and a resistor 20 connected between the diode 19 and the first lead wire 14. The leakage extraneous electric field controller 16 shown as encircled by the alternate long and short dash line, for example, is installed in the flyback transformer 15. The leakage extraneous electric field controller 16 comprises a third coil 21, a conductor 22 and a second lead wire 23. The third coil 21 is a negative pulse generator generating negative pulses having a reverse polarity and a synchronized period with respect to the horizontal deflection voltage signal of the horizontal deflection coil 11. The conductor 22 surrounds the insulation coat 14*a* of the first lead wire 14 at least partially. The second lead wire 23 connects the third coil 21 and the conductor 22. The conductor 22 is configured as a tubular conductor net (FIG. 6) surrounding the end of the flyback transformer side of the insulation coat 14*a* of the first lead wire 14. The resin container 24 is made of insulatiing resin formed by the solid mold manufacturing including the parts for the flyback transformer and the leakage extraneous electric field controller.

Figure 7:
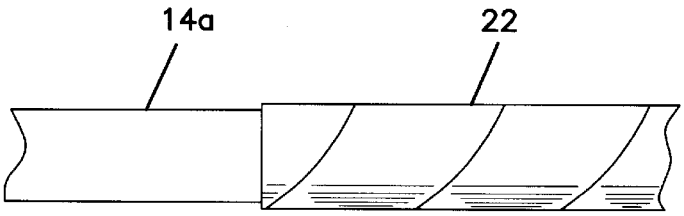
FIG. 7 is an enlarged view of a conducting film layer.

In the above-mentioned first embodiment, the conductor 22 is a tubular conductor net. However, it does not need to be limited to the tubular conductor net. The conductor 22 can be a conducting film layer (FIG. 7), a tubular metal pipe, a metal spring, a tubular metal pipe with the insulation coat, a metal coil spring with an insulating coating, and so on.

Next, the advantageous effect of the cathode ray tube apparatus is explained as follows. The cathode ray tube apparatus can reduce the leakage of the extraneous electric field caused by the ripple signal of the first lead wire 14 having the horizontal deflection period because the leakage extraneous electric field controller 16 reduces the leakage electric field of the first lead wire. In detail, the leakage extraneous electric field controller 16 comprises the third coil 21, which generates negative pulses having a reverse polarity and a synchronized period with respect to the horizontal deflection signal of the horizontal deflection coil 11, the conductor 22, which surrounds the insulating coating 14*a* of the first lead wire 14, and the second lead wire 23, which connects the third coil 21 and the conductor 22. Therefore, the negative pulses generated by the third coil 21 is superimposed to the high voltage signal of the first lead wire 14 via the capacitance formed between the first lead wire 14 and the conductor 22 in order to compensate ripples of the signal having the horizontal deflection period included in the first lead wire 14. Consequently, the leakage extraneous electric field caused by the ripples of the signals having the horizontal deflection period included in the first lead wire 14 can be reduced. In addition, the cost of the cathode ray tube apparatus can be reduced because the expensive smoothing capacitor required conventionally is not necessary due to the capacitance formed between the first lead wire 14 and the conductor 22.

Furthermore, the conductor 22 can be installed within the flyback transformer 15 due to the conductor 22 being formed at the end of the flyback transformer 15 side of the first lead wire 14. Consequently, the safety of the cathode ray tube apparatus is increased because of no possibility of inadvertent direct contact with a hand.

Furthermore, leakage extraneous electric field caused by the pulses having the horizontal deflection period from the flyback transformer 15 and the deflection apparatus 12 can be shielded by the inner conducting film 4 and the outer conducting film 6 of the funnel-shaped part 7. Consequently, the leakage extraneous electric field from the front, side and rear of the cathode ray tube apparatus can be reduced to a low level.

Second Embodiment

The second embodiment of the present invention will be described with reference to FIG. 1 and FIG. 3.

Figure 1:
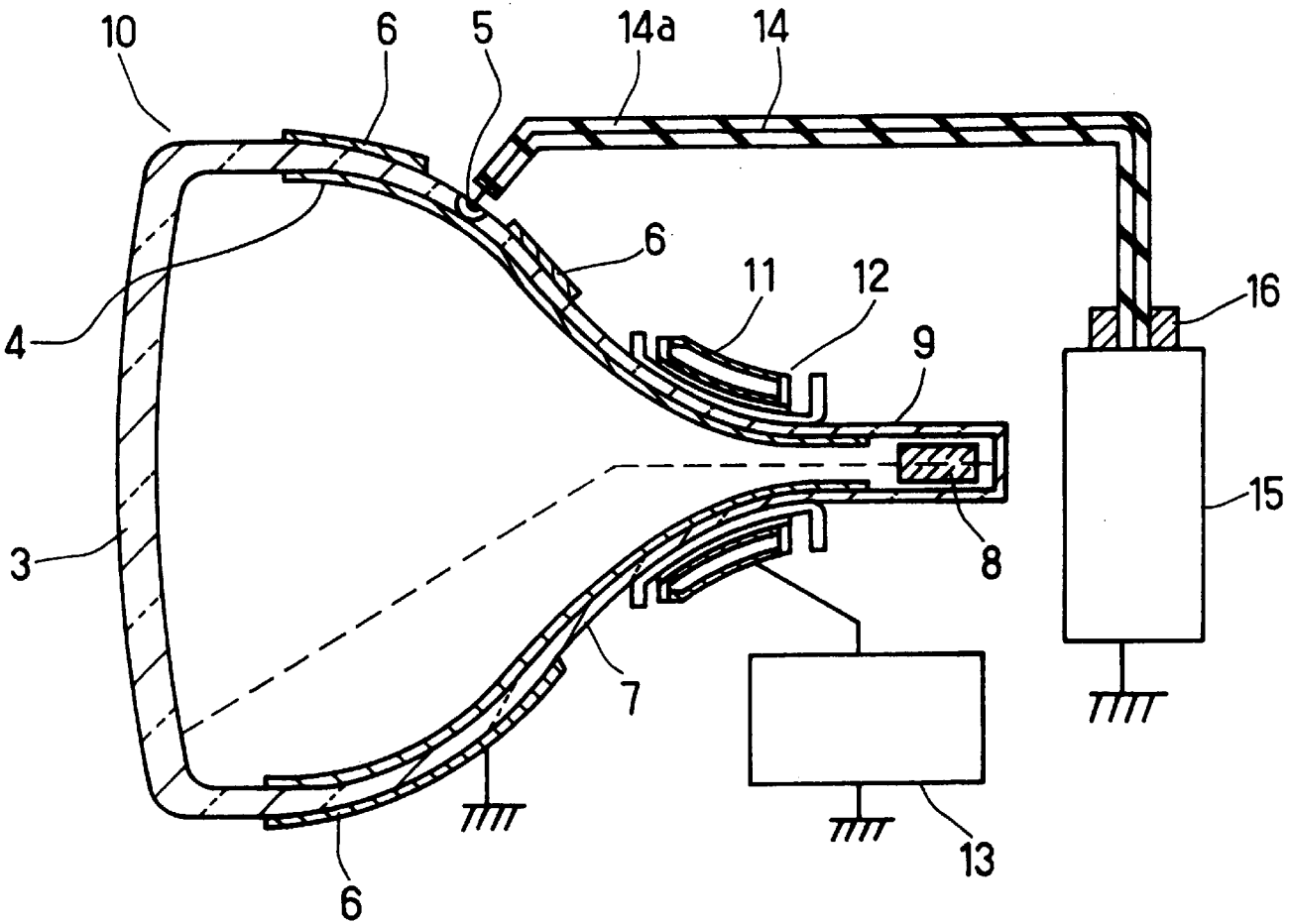
FIG. 1 is a side cross-sectional view of a cathode ray tube apparatus of a first embodiment of the present invention.
Figure 2:
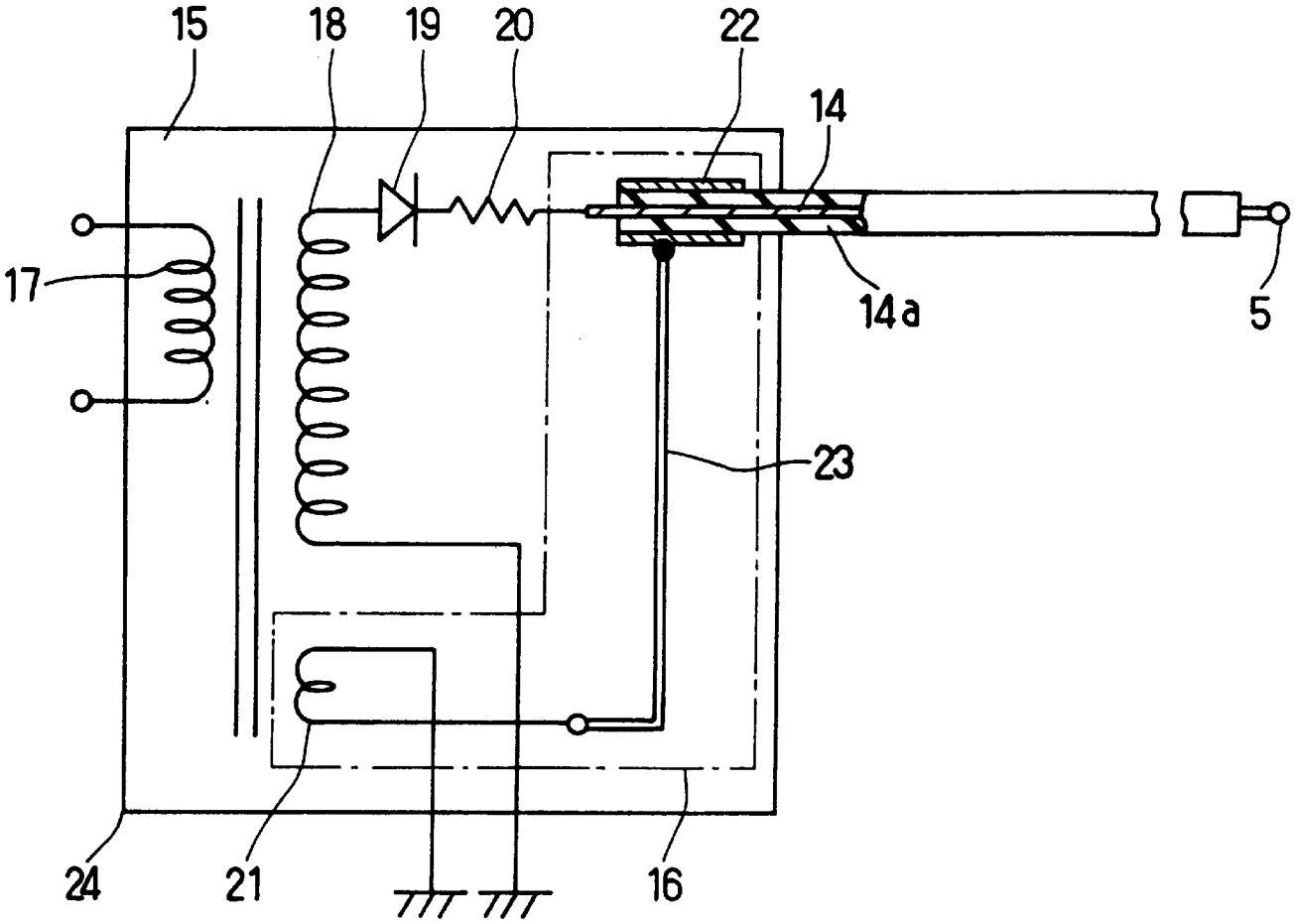
FIG. 2 is a schematic diagram of a flyback transformer and a leakage extraneous electric field controller of the cathode ray tube apparatus of a first embodiment of the present invention.

In a example of the second embodiment of a cathode ray tube apparatus, the basic configuration is the same as that of the first embodiment shown as FIG. 1. FIG. 3 shows a schematic diagram of the flyback transformer and the leakage extraneous electric field controller of the second embodiment of the present invention. The configuration of the flyback transformer and the leakage extraneous electric field controller is different from that of the first embodiment with respect to the conductor 22. The conductor 22 is formed by coiling the end of the second lead wire 23 in a spiral form onto the first lead wire 14 with insulating coating 14*a* .

According to the second embodiment, the conductor 22 is formed by the end part of the second lead wire 23, and the tubular conductor net described in the first embodiment is not required. The configuration of the cathode ray tube apparatus can be simplified. In addition, the capacitance between the conductor 22 of the second lead wire 23 and the first lead wire 14 can be varied and adjusted by varying the number of turns and the pitch of the turns of the spiral coil of the second lead wire 23, and the ripples included in the high voltage signals of the first lead wire 14 can be compensated perfectly.

In the above-mentioned second embodiment, the second lead wire 23 is described as bare metal wire, but a metal wire with an insulating coating can be used instead.

Third Embodiment

Figure 4:
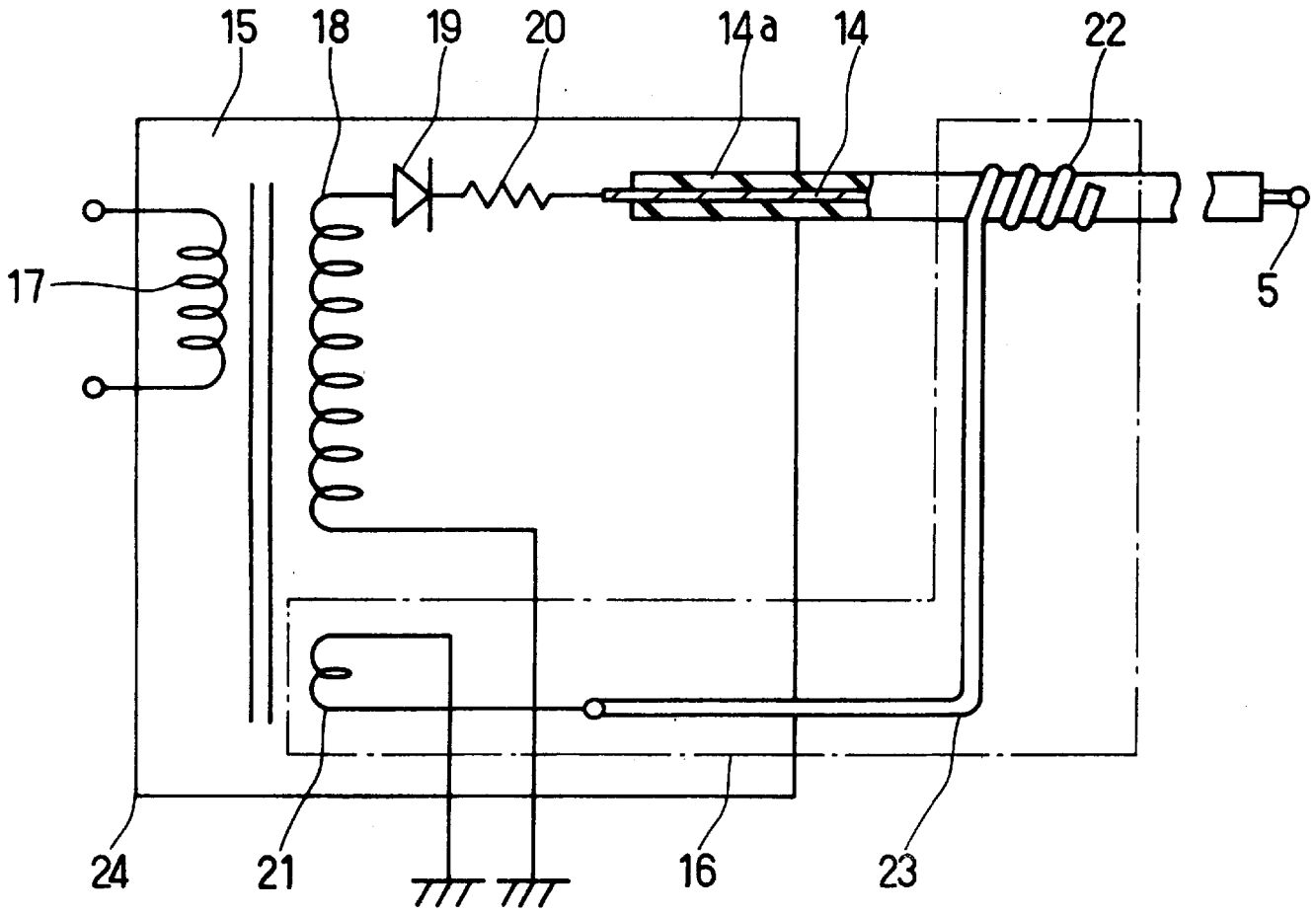
FIG. 4 is a schematic diagram of a flyback transformer and a leakage extraneous electric field controller of the cathode ray tube apparatus of a third embodiment of the present invention.
Figure 5:
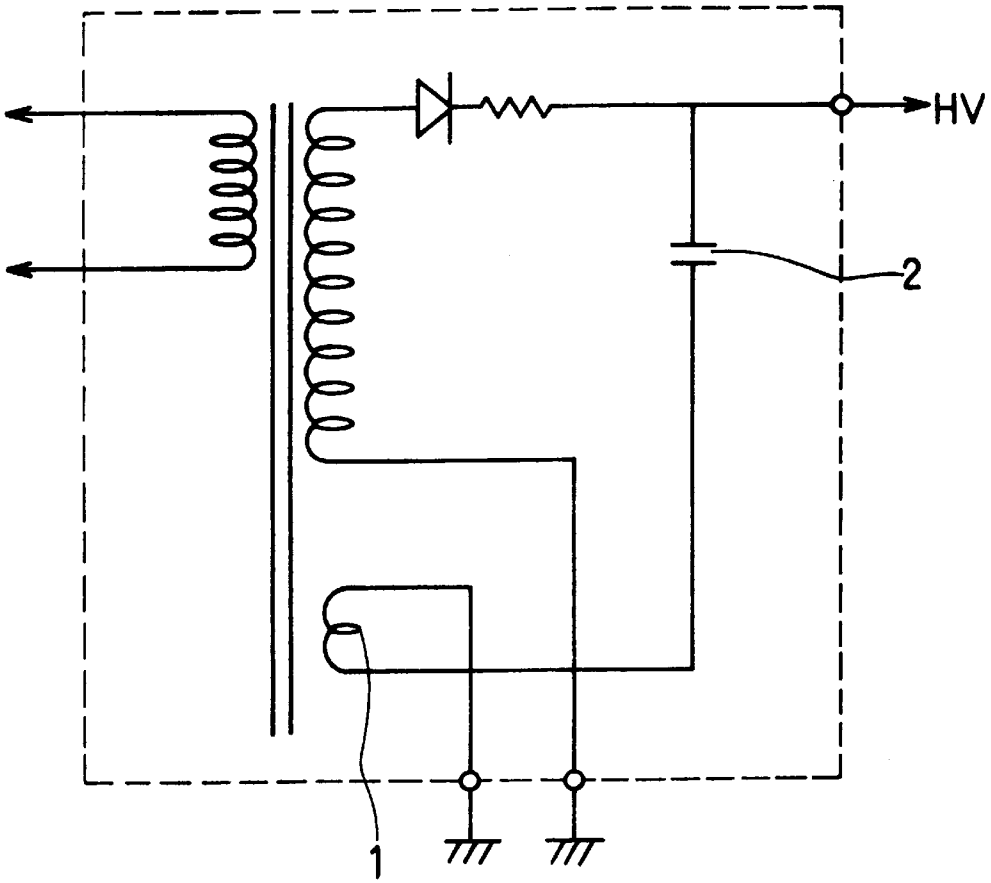
FIG. 5 is a schematic diagram of a flyback transformer and a leakage extraneous electric field controller of a conventional cathode ray tube apparatus.

The third embodiment of the present invention will be described with reference to FIG. 1 and FIG. 4.

In an example of the third embodiment of a cathode ray tube apparatus, the basic configuration is the same as that of the first embodiment shown as FIG. 1. FIG. 4 shows a schematic diagram of the flyback transformer and the leakage extraneous electric field controller of the third embodiment of the present invention. The configuration of the flyback transformer and the leakage extraneous electric field controller is different from that of the second embodiment with respect to the second lead wire 23. The second lead wire 23 is installed with the part of the spiral side being outside of the resin container 24 of the flyback transformer 15.

According to the third embodiment, the ability to vary the number of the turns and the pitch of the turns of the spiral coil of the second lead wire 23 can be increased compared with the second embodiment because the conductor 22 is installed outside of the resin container 24 of the flyback transformer 15.

In the above-mentioned third embodiment, the second lead wire 23 is described as a metal wire, and it is preferable that the second lead wire 23 is an insulation coated metal wire from the view point of safety.

EXAMPLE

The following is an example carried out in order to confirm the effect and advantages of the present invention.

Figure 3:
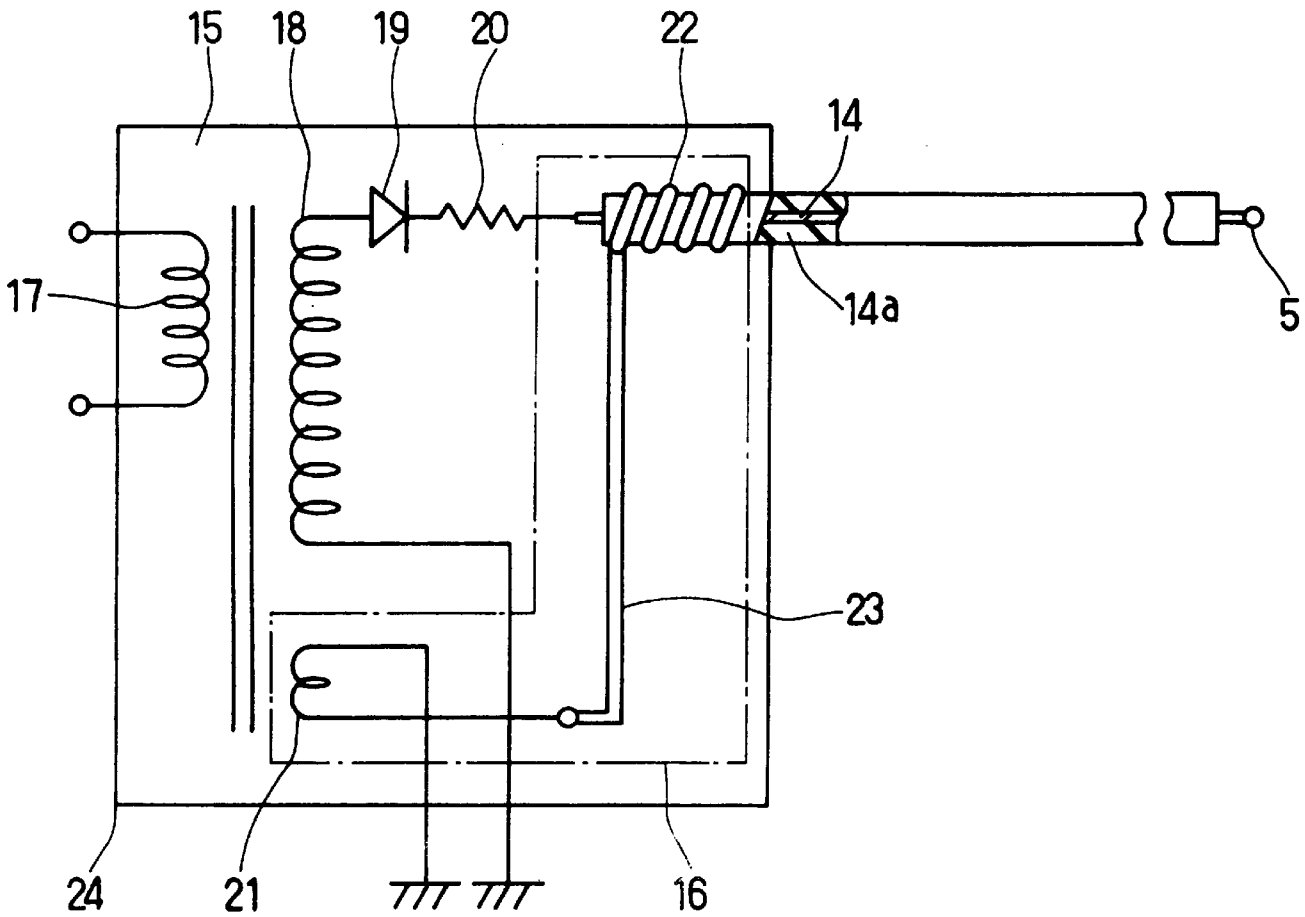
FIG. 3 is a schematic diagram of a flyback transformer and a leakage extraneous electric field controller of the cathode ray tube apparatus of a second embodiment of the present invention.

In the working example, a 17-inch size cathode ray tube shown in FIG. 1 and the flyback transformer 15 and the leakage extraneous electric field controller 16 shown in FIG. 3 were used. In the flyback transformer 15, high direct current voltage applied to the first lead wire 14 from the second coil 18 via the diode 19 and 23 was 3 turns, the pitch of turns of the spiral of the second lead wire 23 was 10 mm (about 0.4 inch), and the voltage of the negative pulse applied to the second lead wire 23 from the third coil 21 was 800 V. In order to compare with the above-mentioned working example, the conventional cathode ray tube apparatus was prepared as a reference example. The reference example comprised the same configuration as the working example without the leakage extraneous electric field controller 16.

The leakage extraneous electric fields of the front, side and rear of both the working example and the reference example were measured by the MPR-2 standard issued at Sweden. According to the MPR-2 standard, the electric field strength of the alternating electric field should be less than 2.5 V/m when the electric field strength is measured at the front, right-hand side, left-hand side and rear at the surface of a 50 cm radius sphere whose center point is at the center of the front panel and the signal frequency band is VLF (Very Low Frequency), 2 kHz to 400 kHz. The results of the measurement of the working example (with the leakage extraneous electric field controller 16) were 1.25 V/m at front, 1.50 V/m at right-hand side, 1.5 V/m at left-hand side and 1.40 V/m at rear. On the other hand, the result of the measurement of the reference example (without the leakage extraneous electric field controller 16) were 2.1 V/m at front, 3.3 V/m at right-hand side, 2.35 V/m at left-hand side and 2.30 V/m at rear. It was obviously found that the working example was able to reduce the leakage extraneous electric field to a low level, which satisfied the MPR-2 standard.

In the above-mentioned working example, the number of turns of the spiral coil of the second lead wire 23 was 3 turns, and the pitch of turns of the spiral coil of the second lead wire 23 was 10 mm (about 0.4 inch). It is obvious that the leakage extraneous electric field will be reduced more if the number of turns of the spiral of the second lead wire 23 is increased more. If the flyback transformer 15 and the leakage extraneous electric field controller 16 shown in FIG. 4 are used, the ability to vary the number of the turns and the pitch of the turns of the spiral coil of the second lead wire 23 can be increased.

The invention may be embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A cathode ray tube apparatus, comprising:

a front panel;

a glass bulb comprising a funnel part including an anode terminal at an outer surface thereof, and a neck part including an electron gun;

a deflection apparatus comprising a horizontal deflection coil on the outer surface of the funnel part and the neck part of the glass bulb;

a flyback transformer connected to the anode terminal of the funnel part via a first lead wire having an insulating coating; and a leakage extraneous electric field controller installed on the first lead wire that reduces leakage of an extraneous electric field from the first lead wire, which comprises:

a negative pulse generator generating a plurality of negative pulses having a reverse polarity and a synchronized period with respect to the horizontal deflection voltage signal of the horizontal deflection coil;

a conductor at least partially surrounding the first lead wire having the insulating coating so that a capacitance between the first lead wire and the conductor is formed; and a second lead wire connecting the negative pulse generator and the conductor, wherein one end of the second lead wire is connected to the negative pulse generator, and the other end of the second lead is connected to the conductor;

wherein the cathode ray tube apparatus reduces the leakage of the extraneous electric field generated by ripples in horizontal deflection signals carried by the first lead wire by compensating the ripples by applying the negative pulses to the conductor.

2. The cathode ray tube apparatus according to claim 1, wherein the conductor is formed at the flyback transformer side end part of the first lead wire.

3. The cathode ray tube apparatus according to claim 1, wherein the conductor is configured as a tubular conductor net.

4. The cathode ray tube apparatus according to claim 1, wherein the conductor is a conductor film formed on the insulation coated first lead wire.

5. The cathode ray tube apparatus according to claim 1, wherein the conductor is formed by coiling an end of a first lead wire side of the second lead wire onto the insulation coated first lead wire.

6. The cathode ray tube apparatus according to claim 1, wherein the conductor is insulation coated.

7. The cathode ray tube apparatus according to claim 1, wherein the conductor is formed at the end part of the insulation coated first lead wire in the flyback transformer.

8. The cathode ray tube apparatus according to claim 1, wherein the conductor is formed at the end part of the insulation coated first lead wire near the outside of the flyback transformer.

9. The cathode ray tube apparatus according to claim 1, wherein the leakage extraneous electric field controller comprises a means for applying the negative pulses to the conductor via the second lead wire; and a means for reducing the leakage extraneous electric field of the first lead wire by compensating ripples in the signals of the first lead wire by the negative pulses applied to the conductor.

10. The cathode ray tube apparatus according to claim 2, wherein the conductor is configured as a tubular conductor net.

11. The cathode ray tube apparatus according to claim 2, wherein the conductor is a conductor film formed on the insulation coated first lead wire.

12. The cathode ray tube apparatus according to claim 2, wherein the conductor is formed by coiling an end of a first lead wire side of the second lead wire onto the insulation coated first lead wire.

13. The cathode ray tube apparatus according to claim 2, wherein the conductor is insulation coated.

14. The cathode ray tube apparatus according to claim 3, wherein the conductor is insulation coated.

15. The cathode ray tube apparatus according to claim 4, wherein the conductor is insulation coated.

16. The cathode ray tube apparatus according to claim 5, wherein the conductor is insulation coated.

* * * * *